United States Patent [19]

Karnes et al.

[11] Patent Number: 4,934,080

[45] Date of Patent: Jun. 19, 1990

[54] CONSUMER INFORMATION DISPLAY DEVICE

[76] Inventors: Harry D. Karnes, 3530 Windsor Dr., Boise, Id. 83705; Richard Farnsworth, 4033 Yorktown Way, Boise, Id. 83706

[21] Appl. No.: 335,209

[22] Filed: Oct. 31, 1988

Related U.S. Application Data

[63] Continuation of Ser. No. 40,988, Apr. 20, 1987, abandoned.

[51] Int. Cl.[5] ..... G09F 3/20

[52] U.S. Cl. ..... 40/649; 40/642; 40/657; 40/666

[58] Field of Search ..... 40/642, 649, 651, 652, 40/654, 657, 662, 666, 124, 124.1; 211/54.1, 57.1, 59.1; 248/220.3, 220.4, 221.1, 221.2

[56] References Cited

U.S. PATENT DOCUMENTS

| | | | |
|---|---|---|---|
| 2,547,239 | 4/1951 | Walker | 40/23 R |
| 2,549,467 | 4/1951 | Hopp et al. | 40/23 R |
| 2,972,201 | 2/1961 | Niedermayer | 40/23 R |
| 3,367,340 | 2/1968 | David et al. | 40/401 |
| 3,912,084 | 10/1975 | Valiulis | 248/220.4 |
| 4,018,341 | 4/1977 | Jarecki | 211/59.1 |
| 4,066,169 | 1/1978 | Hochman | 248/220.3 |
| 4,286,764 | 9/1981 | Pfeifer | 248/220.3 |
| 4,292,749 | 10/1981 | Thomas | 40/23 R |
| 4,351,440 | 9/1982 | Thalenfeld | 40/19.5 |
| 4,394,909 | 7/1983 | Valiulis et al. | 248/220.3 |
| 4,525,944 | 7/1985 | Fast | 40/19.5 |
| 4,531,313 | 7/1985 | Fast | 40/19.5 |
| 4,646,454 | 3/1987 | Fast | 40/19.5 |
| 4,693,024 | 9/1987 | Fast | 40/19.5 |
| 4,694,595 | 9/1987 | Fast | 40/20 A |
| 4,698,929 | 10/1987 | Fast | 40/124.1 |
| 4,715,135 | 12/1987 | Fast | 40/20 R |

*Primary Examiner*—Gene Mancene
*Assistant Examiner*—Michael Lynch
*Attorney, Agent, or Firm*—Frank J. Dykas

[57] ABSTRACT

A clasp slidable and removably mountable on a merchandise display hook for removably mounting a consumer information flag to the merchandise display hook. Facilitates mounting and dismounting such consumer information flag by eliminating the necessity therefor to dismount the cooperating merchandise display hook or to remove adjacently-displayed merchandise. Enables mounting such consumer information flag regardless of the means of attachment of the merchandise display hook to the cooperating display board, and at any radial orientation with respect to the major axis of such hook. Enables inventory control specific to an individual merchandise display hook.

6 Claims, 4 Drawing Sheets

CONSUMER INFORMATION DISPLAY DEVICE

This is a continuation of application Ser. No. 040,988, filed on Apr. 20, 1987, now abandoned.

BACKGROUND OF THE INVENTION

FIELD OF THE INVENTION

This invention relates to merchandising devices and in particular to devices for mounting consumer information flags to merchandise display hooks.

DESCRIPTION OF THE PRIOT ART

A variety of means have been developed to display printed consumer information such as identifying articles for sale and unit prices in connection with merchandise displays. One branch of this art, as exemplified in U.S. Pat. Nos. 4,463,510 and 4,583,308, comprises the use of an adjustable and deformable perforated ribbon-like bands as consumer information flats co-mounted with a display hook. U.S. Pat. No. 4,463,510 shows a consumer information flag pinned through and against a vertical pegboard display base by the mounting prongs of the cooperative display hook.

U.S Pat. No. 4,583,308 shows a similar consumer information flag but adapted to two selective orientation modes, with its minor axis horizontal or vertical. This device is also pins the consumer information flag through and against the pegboard.

In both U.S. Pat. Nos. 4,463,510 and 4,583,308 the means of attaching the consumer information flag onto the cooperative display hook inherently requires, by their designs, that the display hook be dismounted from the pegboard in order to remove, change, reorient, shorten or lengthen the consumer information flag. This is necessary because the display hook must be swiveled upward, pivoting about its attachment point, at the pegboard, in order to disengage its mounting prongs from the pegboard. This operation is troublesome because merchandise displays arrayed close above the display hook being removed will interfere with and perhaps prevent the operation. As a result, merchants often find it necessary to remove all merchandise displays in a vertical line before a consumer information flag located at the bottom of the pegboard display is accessible for changing. This is a great inconvenience.

Inventory control is another problem with peg board displays. Usually, any single pegboard display will have thereon at least ten and perhaps hundreds of pegs for the display of merchandise held for sale. All the pegs thereon will normally be of the same length so as to enhance the visual appearance of the display. However, the merchandise being displayed will not necessarily sell at the same rate. The merchant will sell more of one particular item than of another. In today's competitive market it is advantageous for the merchant to stock, or hold in inventory, only enough of any particular item to meet current consumer demands per restocking time interval. As a result, a merchant may carry perhaps only a few units of slower moving merchandise while stocking, on the same pegboard, many more of higher volume type of merchandise.

It would be advantageous for the merchant to be able to hold all of the merchandise at a uniform distance out from the pegboard, so as to enhance the visual appearance of the display, and secondly be able to monitor the rate of sales. Neither of these goals is easily accomplished with the use of current pegboard display devices and consumer information flags.

Also, most merchants hold items for sale, and maintain inventory control for purposes of pricing on a first in first out basis. Therefore, when a pegboard display is restocked, the newer merchandise is placed at the back of the peg with the older merchandise being pushed forward to the end. In this manner the merchant is able to rotate his stock and thereby eliminate waste through aging merchandise, and, also to facilitate accurate accounting based upon unit prices which may fluctuate up or down.

What is needed, as an aid in inventory control, is a method of marking the display peg so as to limit the amount of shaft space available for holding merchandise and thereby limit the amount of inventory that can be placed on that peg when the vendor is restocking it. Most merchandise displayed on peg boards is prepackaged with a punched hold through which the shaft of the peg is inserted. Once the clasp is property positioned on the peg, merchandise packages cannot be slid back beyond the clasp. And finally, there is a need for a method of holding the merchandise at the front end of the peg so as to enhance the visual appearance of the display.

Accordingly, it is a first object of this invention to provide a low cost and easy to use means for mounting and dismounting a consumer information flag without the necessity of dismounting the cooperating display hook. It is a second object to provide a means of mounting a consumer information flag which is adaptable for use with any hook, regardless of the hook's attachment means or configuration. Another object is to provide a convenient means for mounting consumer information flags at any desired angle.

Another important object is to provide a convenient and low cost inventory control means integral with the consumer information flag mounting means. And, finally, it is an object of this invention to provide a consumer information flag attachment means which is adaptable to holding displayed merchandise at the front end of the peg.

SUMMARY OF THE INVENTION

These objects are accomplished by the use of a consumer information flag clasp which is slidably and removably mountable on a merchandise display hook. The clasp, made of resilient material, has a receiving plate for holding the rearwardly extending tab of a consumer information flag, and is attached to the shaft of the display hook by means of two semicircular resilient claws defining a cylindrical hole of conforming size and shape to the shaft of the display hook. The shaft hole defined by the semi-circular claws of the clasp is slightly smaller in diameter than that of the shaft of the cooperating display hook, and as a result the entire clasp is held by frictional engagement with the shaft of the display hook in any orientation and at any location along the shaft, that is desired by the merchant.

DETAILED DESCRIPTION OF THE PREFERRED EMBODIMENT

Figure 1:
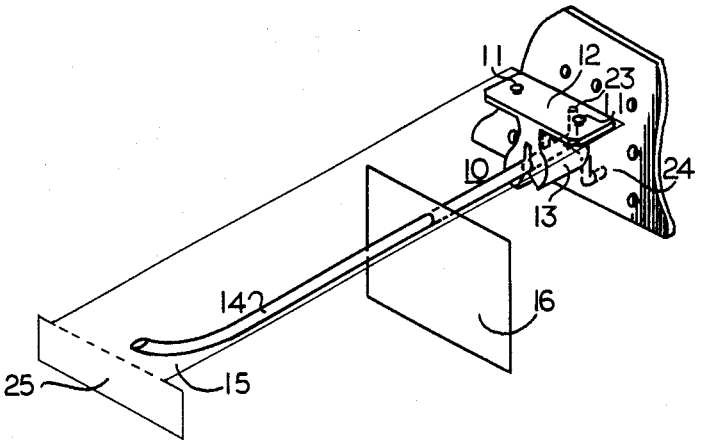
FIG. 1 is a prospective view of the clasp shown with a consumer information flag attached.
Figure 2:
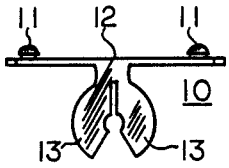
FIG. 2 is a front elevation view.
Figure 3:
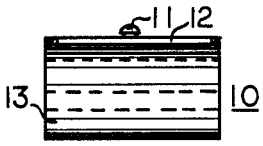
FIG. 3 is a side elevation view of the clasp.

First referring to FIGS. 1, 2, and 3, there is shown therein the most common embodiment of my new clasp, generally described as 10. Display hook shaft 14 is a typical display shaft which is attached to three peg board insertion prongs, two of which are shown in FIG. 1 as 23 and 24. Upper prong 23 is inserted through a selected hole in the pegboard when the display hook is vertically oriented so as to allow this type of insertion. Display shaft 14 is then rotated downward about the pivot point defined by the intersection of upper attachment prong 23 and the hole in the pegboard. With the display hook in a horizontal plane lower attachment prong 24 and a second prong, not shown, will be inserted through additional holes in the pegboard thereby anchoring the display shaft 14 and holding it in a horizontal position. The consumer information flag has forward facing flag 25 for use in displaying consumer information such as identifying the item and its unit price. It also has rearwardly extending tab 15 which has at least two pre-cut holes for frictional engagement with posts 11 of clasp 10.

Referring to FIGS. 1, 2 and 3, clasp 10 has posts 11 attached to platform 12, and adapted in size and shape for frictional insertion through the holes of tab 15. Platform 12 is held on the shaft of 14 of the display hook by frictional engagement of two semi-circular claws 13 which define a saddle for frictional engagement with display hook shaft 14.

In this typical embodiment the consumer information flag 25 is held and supported in front of display hook shaft 14 with relative stability by the fact that the two posts 11 hold tab 15 parallel to display hook shaft 14. It is supported at the front end by the fact that tab 15 rests freely atop the front of display hook shaft 14.

Figure 8:
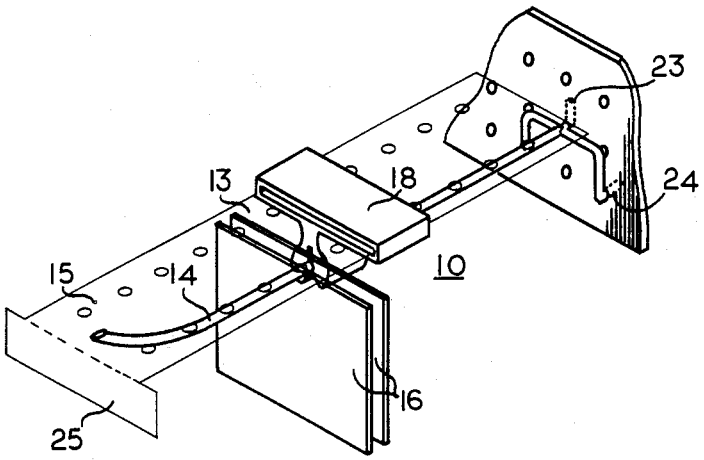
FIG. 8 is a perspective representational view of a slotted clasp being used for inventory control.

Merchandise held for sale on peg board displays is typically individually packaged with some sort of a label or seal across the top of the package wherein a hole is punched as can been seen as merchandise 16 as seen in FIGS. 1 and 8. With the first embodiment, as described above, the vendor restocking the peg board display merely has to lift up flag 25 and slide shaft 14 through the hole. However, since the vendors, and not the retail merchant, normally restock the peg board displays, inventory control becomes a problem.

In peg board displays having tens and perhaps hundreds of different items held for sale, some of those items will sell at a much faster rate than others. For example, a first item may sell at the rate of forty units per week, while a second item located on an adjacent peg will sell at only three units per week. If the vendor restocking interval was once a week, then it would be desireable to have an inventory of fifty of the first item and only five of the second. Yet, if the pegs are of uniform length, the vendor when restocking the peg board display, will fill all of the pegs with as many items as is feasible, resulting in the retail merchant having an inventory of fifty units of the first item and fifty units of the second item, even though five units of the second item would be a sufficient quantity.

Figure 4:
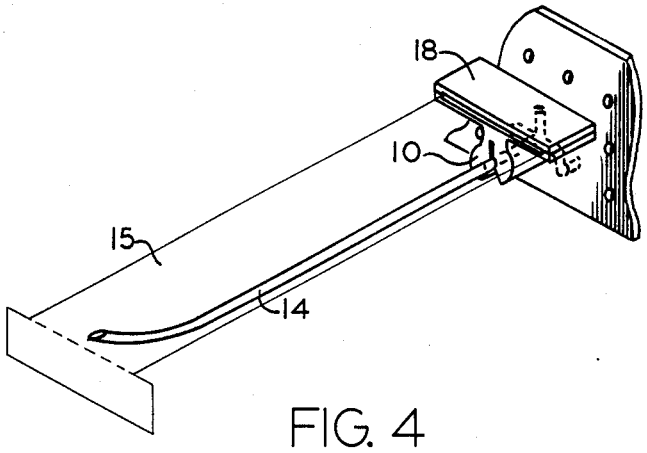
FIG. 4 is a perspective representational view of a slotted clasp.

FIGS. 4 and 8 disclose a second embodiment which is particularly well adapted for solving the inventory control problem described above. As can be seen, receiving platform 12 of clasp 10 has, affixed atop it, cover plate 18, which, with receiving platform 12, defines a slot for receiving and holding tab 15 of the consumer information flag. In this manner, clasp 10 can be slid along the display hook shaft 14 and still utilize the uniformly sized consumer information flag 15. As a result, a merchant can easily maintain inventory control, by sliding clasp 10, as is shown in FIG. 8, along display hook shaft 14 without having to change the consumer information flags.

This embodiment has an additional advantage in that it facilitates holding all the displayed merchandise at the front of the pegs, thereby enhancing the visual appearance and effectiveness of the merchandise display.

Figure 5:
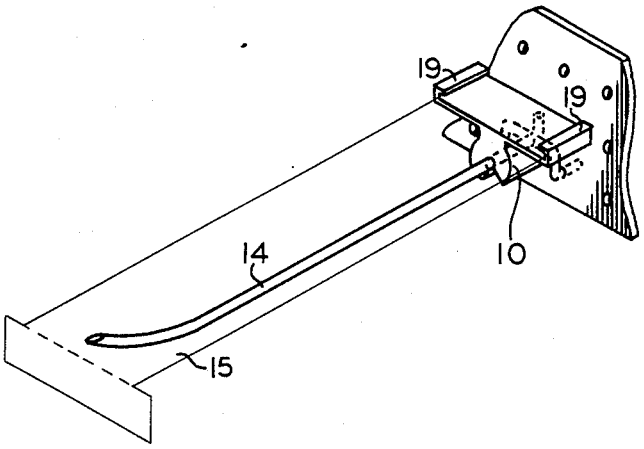
FIG. 5 is a perspective elevational view of a notched clasp.

FIG. 5 discloses yet another method of holding and affixing consumer information flag tab 15 to clasp 10. In this embodiment, upwardly extending tabs 19 define notches atop receiving platform 12 for frictional engagement with the sides of extending tab 15.

Figure 6:
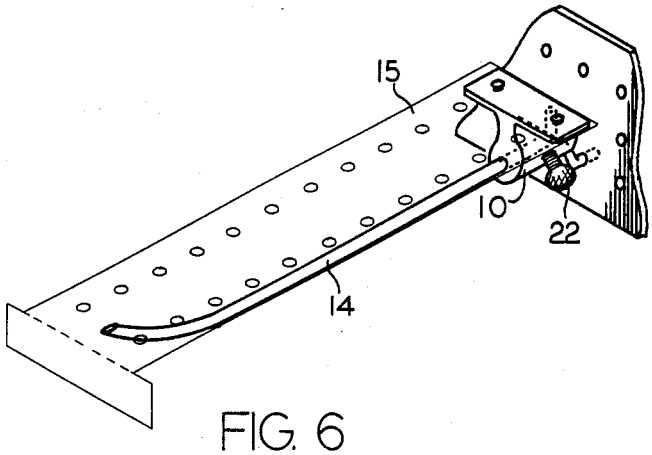
FIG. 6 is a perspective elevational view of a clasp having a set screw.

All of the clasps shown in FIGS. 1 through 5 and 7 show a pair of semi-circular claws 13 made of resilient material, which define a cylindrical hole for receiving display hook shaft 14 and being held thereto by means of frictional engagement. In FIG. 6 another embodiment is shown wherein set screw 22 is used to hold clasp 10 in position on display hook shaft 14.

Figure 7:
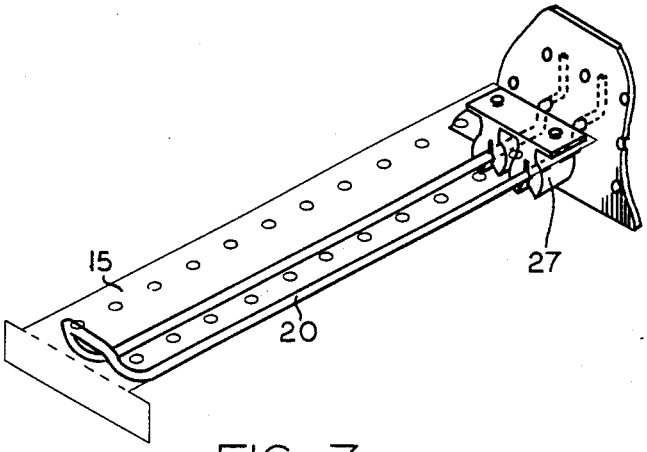
FIG. 7 is a perspective elevational view of a clasp for use with a double runner hook.

FIG. 7 discloses yet another embodiment for use with double hook 20. In this embodiment clasp 21 has two sets of semicircular claws for clasping both shafts of display hook 20.

While there is shown and described the present preferred embodiments of the invention, it is to be distinctly understood that the invention is not limited thereto but may be variously embodied to practice within the scope of the following claims. Accordingly,

What we claim is:

1. A merchandise inventory control and information display device, for use on an elongated merchandise display hook, which comprises:

a consumer information flag having a forward facing flag and a rearwardly extending tab having a plurality of holes disposed along a line perpendicular to the major axis of the merchandise display hook;

a receiving platform slidably receiving and supporting a portion of said rearwardly extending tab, said platform further having at least one post of size and shape removably engaging said plurality of holes in said rearwardly extending tab; and a pair of semi-circular resilient claws attached to said platform, defining a cylindrical hole for receiving and frictionally engaging the elongated shaft of the merchandise display hook at any point along its major axis.

2. A merchandise inventory control and information display device, for use on an elongated merchandise display hook, which comprises:

a consumer information flag having a forward facing flag and a rearwardly extending tab;

a receiving platform slidably receiving and supporting a portion of said rearwardly extending tab, said platform further having a cover plate attached in parallel spaced relationship to said receiving platform, defining a slot receiving said rearwardly extending tab; and a pair of semi-circular resilient claws attached to said platform, defining a cylindrical hole for receiving and frictionally engaging the elongated shaft of the merchandise display hook at any point along its major axis.

3. A merchandise inventory control and information display device, for use on an elongated merchandise display hook, which comprises:

a consumer information flag having a forward facing flag and a rearwardly extending tab;

a receiving platform slidably receiving and supporting a portion of said rearwardly extending tab, said platform further having a pair of upwardly extending retaining edges attached thereto, said edged, frictionally engaging the sides of said rearwardly extending tab; and a pair of semi-circular resilient claws attached to said platform, defining a cylindrical hole for receiving and frictionally engaging the elongated shaft of the merchandise display hook at any point along its major axis.

4. A merchandise inventory control and information display device, for use on an elongated merchandise display hook, which comprises:

a consumer information flag having a forward facing flag and a rearwardly extending tab having a plurality of holes disposed along a line perpendicular to the major axis of the merchandise display hook;

a receiving platform slidably receiving and supporting a portion of said rearwardly extending tab, said platform further having at least one post removably engaging said plurality of holes in said rearwardly extending tab; and a cylindrical clasp attached to said receiving platform having a cylindrical hole therein for receiving the elongated shaft of the merchandise display hook and further having a radially disposed set screw for biasing said clasp at any point along the elongated shaft of the merchandise display hook.

5. A merchandise inventory control and display device, for use on an elongated merchandise display hook, which comprises:

a consumer information flag having a forward facing flag and a rearwardly extending tab;

a receiving platform slidably receiving and supporting a portion of said rearwardly extending tab, said platform further having a cover plate attached in parallel spaced relationship to said receiving platform, defining a slot receiving said rearwardly extending tab; and a cylindrical clasp attached to said receiving platform having a cylindrical hole therein for receiving the elongated shaft of the merchandise display hook and further having a radially disposed set screw for biasing said clasp at any point along the elongated shaft of the merchandise display hook.

6. A merchandise inventory control and information display device, for use on an elongated merchandise display hook, which comprises:

a consumer information flag having a forward facing flag and a rearwardly extending tab;

a receiving platform slidably receiving and supporting a portion of said rearwardly extending tab, said platform further having a pair of upwardly extending retaining edges attached thereto, said edges frictionally engaging the sides of said rearwardly extending tab; and a cylindrical clasp attached to said receiving platform having a cylindrical hole therein for receiving the elongated shaft of the merchandise display hook and further having a radially disposed set screw for biasing said clasp at any point along the elongated shaft of the merchandise display hook.

* * * * *